US006218996B1

(12) United States Patent
Shuen

(10) Patent No.: US 6,218,996 B1
(45) Date of Patent: Apr. 17, 2001

(54) CAR ANTENNA SEAT

(75) Inventor: Shun Tian Shuen, Taipei (TW)

(73) Assignee: Janchy Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/414,512

(22) Filed: Oct. 8, 1999

(51) Int. Cl.[7] ..... H01Q 1/06
(52) U.S. Cl. ..... 343/721; 343/711; 343/713
(58) Field of Search ..... 343/711, 712, 343/713, 704, 721, 715, 892, 893, 878, 888, 900, 872; H01Q 1/06, 1/32

(56) References Cited

U.S. PATENT DOCUMENTS

| | | | | |
|---|---|---|---|---|
| 2,528,590 | * | 11/1950 | Garlow | 343/713 |
| 4,785,305 | * | 11/1988 | Shyu | 343/713 |
| 5,402,135 | * | 3/1995 | DeMarre et al. | 343/715 |
| 5,448,456 | * | 9/1995 | Huynh | 362/80 |
| 5,898,408 | * | 4/1999 | Du | 343/715 |

* cited by examiner

*Primary Examiner*—Tho Phan

(74) *Attorney, Agent, or Firm*—Bacon & Thomas

(57) ABSTRACT

A car antenna seat including a base seat, an upper cover, a decorative cover and antennas. The top face of the base seat is disposed with an arch slope face formed with opposite through holes. Several receptacles are side by side formed on the base seat and separated from the other by ribs. An engaging socket extends from one end of the receptacle. A double-face adhesive tape is disposed on the bottom face of the base seat. The upper cover is formed with locating posts for inserting into the through holes of the base seat. Two sides of the rear end of the upper cover are formed with two lugs each having a circular hole. A notch is formed beside the lug for a stopper block to insert therein. The stopper block is formed with several through holes for adjustment screws to pass therethrough. Two sides of a face of the decorative cover are formed with opposite connecting holes and an inner bottom face of the decorative cover is disposed with an engaging block. The surface of the decorative cover is integrally formed with a solid decorative pattern. Each antenna is integrally formed. A light emitting section is disposed at top end of the antenna. The light emitting section contains a diode enclosed by a transparent shade. A middle section of the antenna is formed with a spring pattern and the bottom end of the antenna is disposed with an insertion section. A conductive wire is disposed in the antenna. The antennas are arranged side by side and electrically connected with each other by a parallel conductive plate.

4 Claims, 8 Drawing Sheets

CAR ANTENNA SEAT

BACKGROUND OF THE INVENTION

The present invention relates to a car antenna seat which permits the antennas to be freely adjusted and located by any angle. The base seat can be assembled with different upper covers and decorative covers with different patterns so as to provide versatile appearances and achieve a decorative effect.

Most of the conventional car antenna seats employ telescopic antennas or antennas wrapped by rubber skin to provide a certain flexibility and avoid damage in use. Moreover, in the case that a television is additionally installed in the car. Additional antenna is installed for achieving better visual effect. The above conventional car antenna seats cannot be freely adjusted in angle and have monotonous appearance.

SUMMARY OF THE INVENTION

It is therefore a primary object of the present invention to provide a car antenna seat which permits the antennas to be freely adjusted and located by any angle.

It is a further object of the present invention to provide the above car antenna seat which is equipped with a light emitting section having different colors of bulbs for providing a light emitting effect.

The present invention can be best understood through the following description and accompanying drawings wherein:

DETAILED DESCRIPTION OF THE PREFERRED EMBODIMENTS

Figure 1:
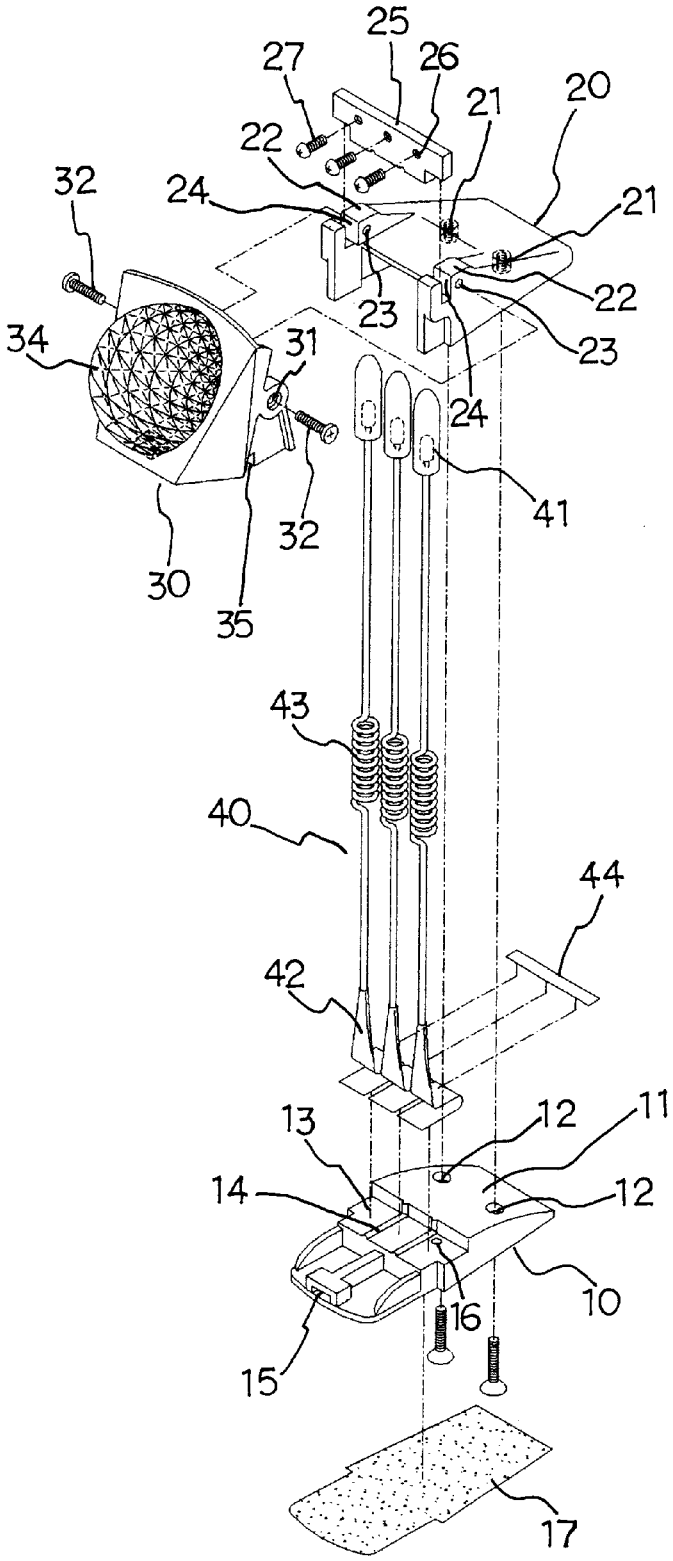
FIG. 1 is a perspective exploded view of the present invention.
Figure 2:
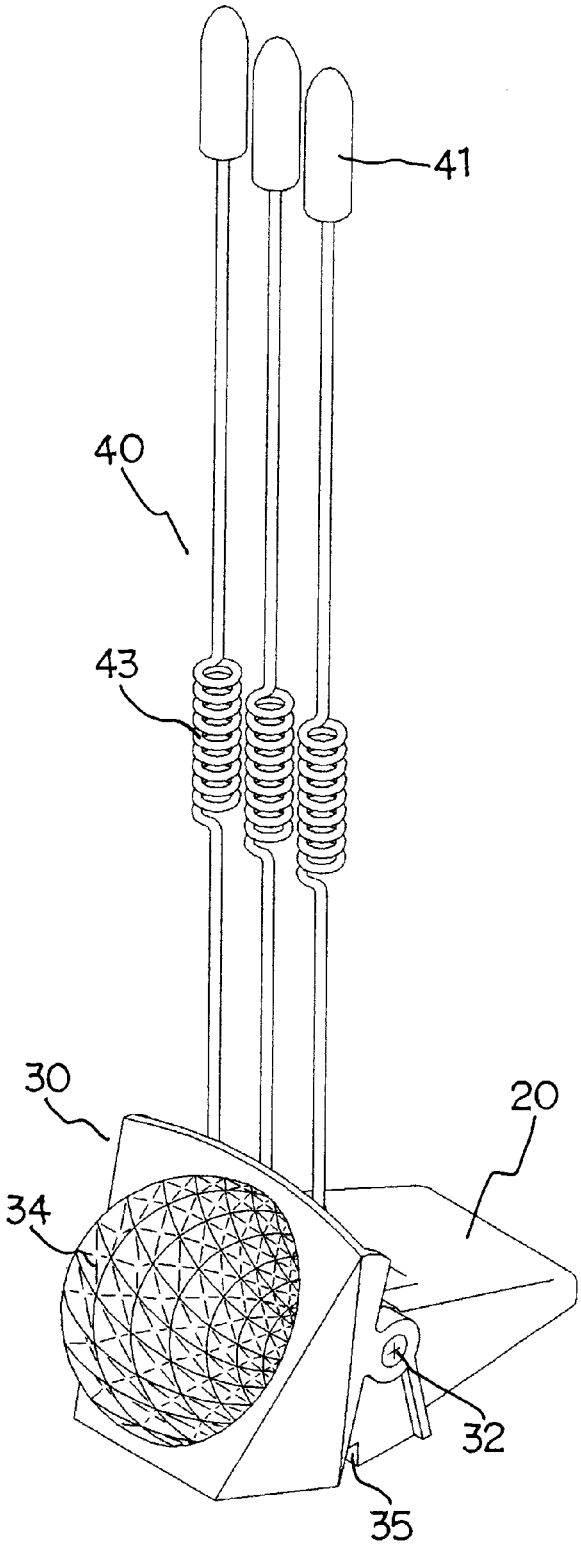
FIG. 2 is a perspective assembled view of the present invention.
Figure 3:
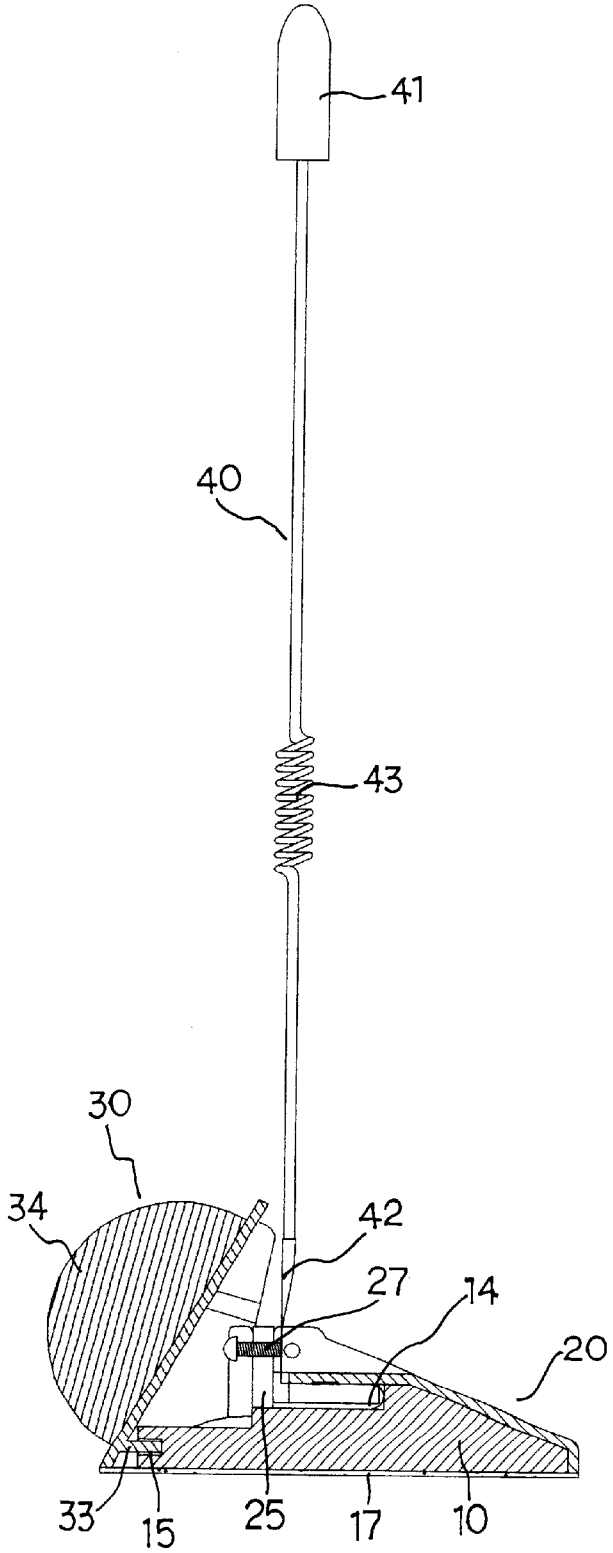
FIG. 3 is a side sectional view of the present invention.

Please refer to FIGS. 1 to 3. The car antenna seat of the present invention includes a base seat 10, an upper cover 20, a decorative cover 30 and an antenna 40.

Referring to FIG. 1, a half section of the top face of the base seat 10 is formed with an arch slope face 11 The slope face 11 is formed with opposite through holes 12. Several receptacles 13 are formed adjacent to the slope face 11 for receiving the antenna 40. Each receptacle 13 is separated from the other by a rib 14. An engaging socket 15 extends from the rear end of the receptacle 13. The receptacle 13 on the right side is formed with a wire perforation 16. In addition, a double-face adhesive tape 17 is disposed on the bottom face of the base seat 10.

The upper cover 20 serves to mate with and cover the slope face 11 of the base seat 10. The inner wall face of the upper cover is formed with locating posts 21 for inserting into the through holes 12 of the base seat. Screws are screwed into the locating posts to lock the upper cover with the base seat. Two sides of the rear end of the upper cover 20 are formed with two lugs 22 each having a circular hole 23. A notch 24 is formed beside the lug 22 for a stopper block 25 to insert therein. The stopper block 25 is formed with several through holes 26 at equal intervals in which adjustment screws 27 are fitted.

The decorative cover 30 mates with and covers the receptacles 13 of the base seat 10. Two sides of a face of the decorative cover mating with the upper cover 20 are formed with opposite connecting holes 31. Screws 32 are passed through the connecting holes 31 and the circular holes 23 so as to connect the decorative cover 30 with the upper cover 20. An inner bottom face of the decorative cover 30 is disposed with an engaging block 33 (not shown) for inserting into the engaging socket 15 of the base seat 10 so as to firmly connect the decorative cover 30 with the base seat 10. The surface of the decorative cover 30 is integrally formed with a solid decorative pattern 34. Two lateral walls of the decorative cover 30 are formed with wire channel 35.

Figure 4:
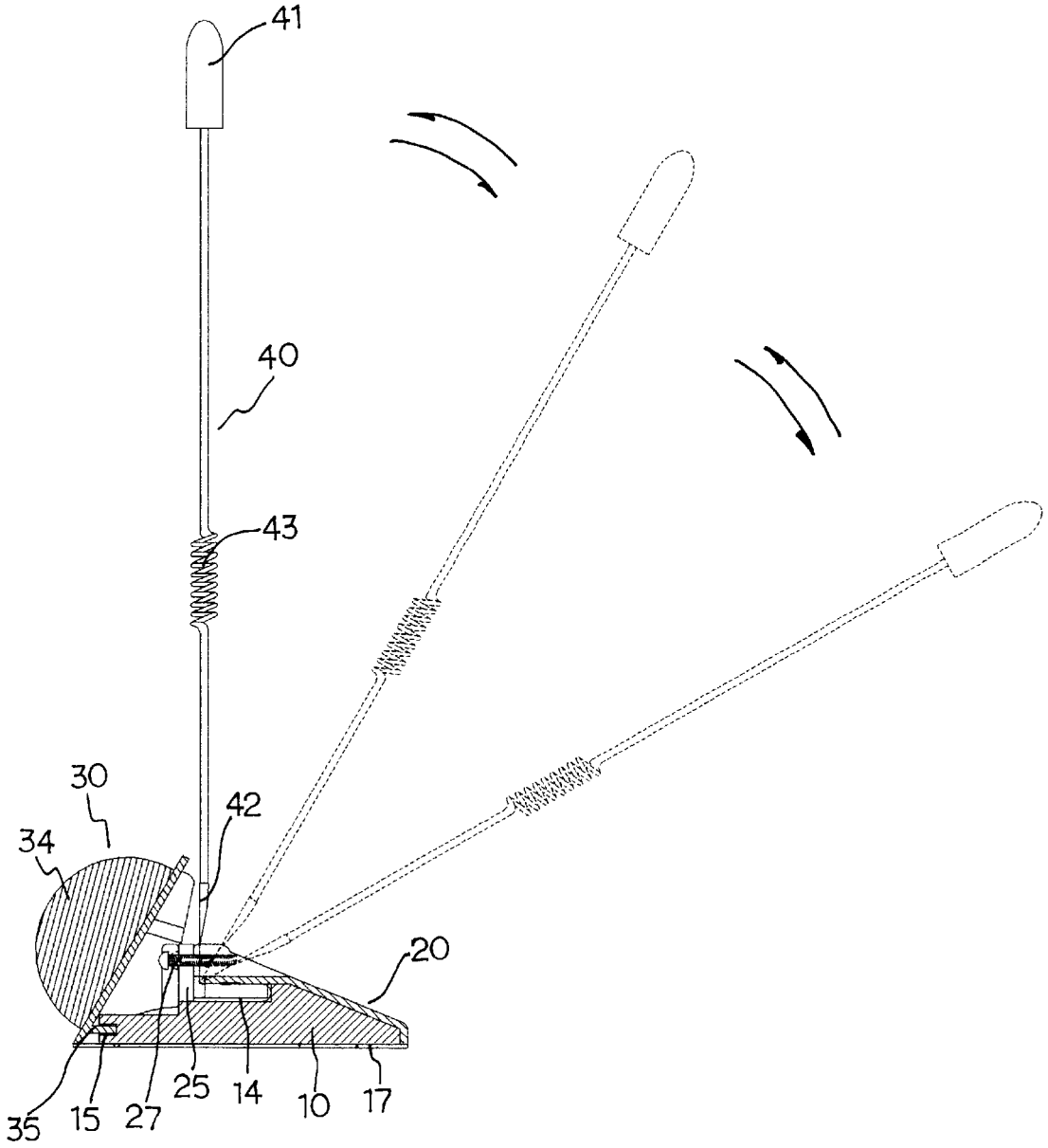
FIG. 4 is a view according to FIG. 3, showing the adjustment of the present invention.

In this embodiment, there are three antennas 40. Each antenna 40 is integrally formed. A light emitting section 41 is disposed at top end of the antenna. The light emitting section 41 contains a diode enclosed by a transparent shade. A middle section of the antenna is formed with a spring pattern 43 to provide a swinging effect. The bottom end of the antenna is disposed with an insertion section 42. A conductive wire is disposed in the antenna 40. The insertion section 42 is inserted into the receptacle 13 of the base seat 10. The conductive wire is passed through the wire perforation 16 and the wire channel 35. The antennas 40 are arranged side by side and electrically connected with each other by a parallel conductive plate 44. The inclination angle of each antenna 40 is controllable by the adjustment screw 27 (as shown in FIG. 4).

Figure 5:
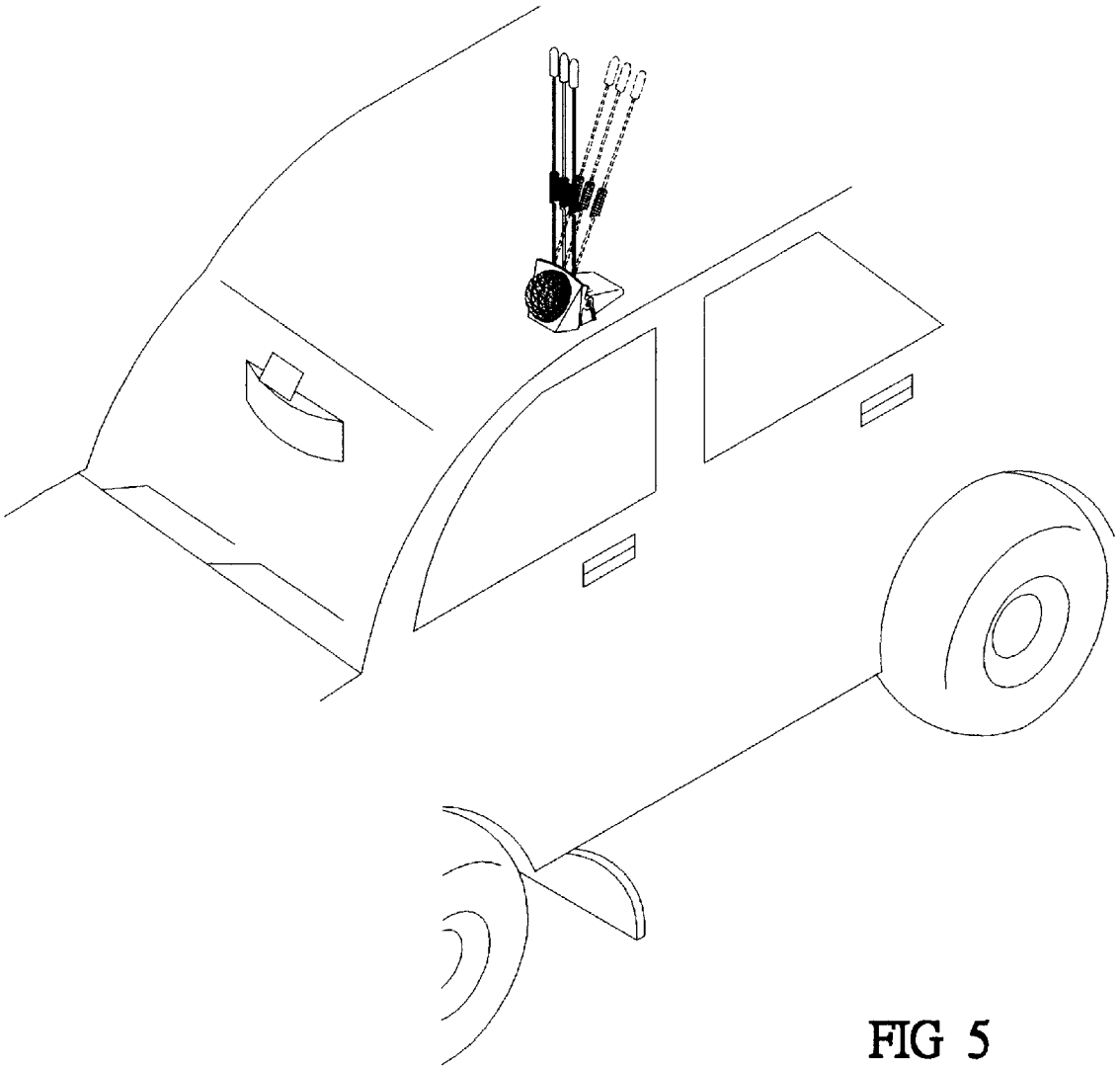
FIG. 5 shows the installation of the present invention on a car.
Figure 6A:
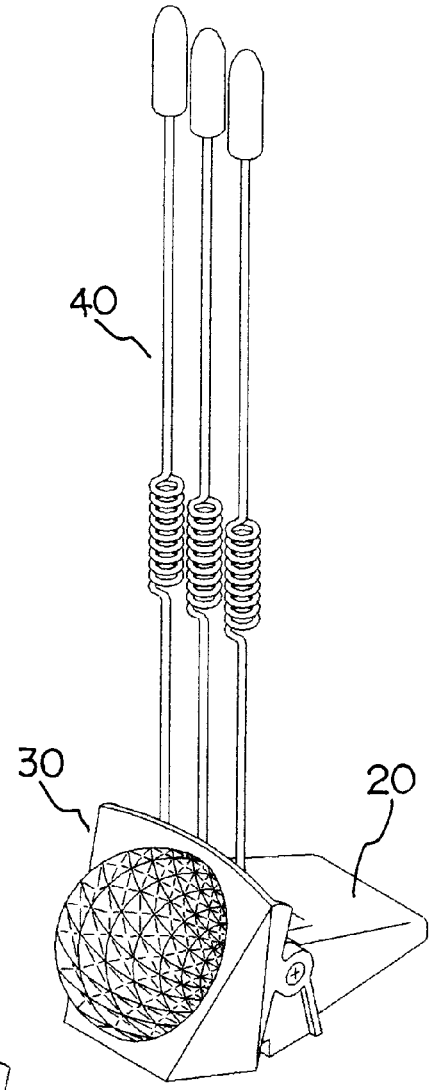
FIGS. 6A to 6C show different embodiments of the present invention.
Figure 6B:
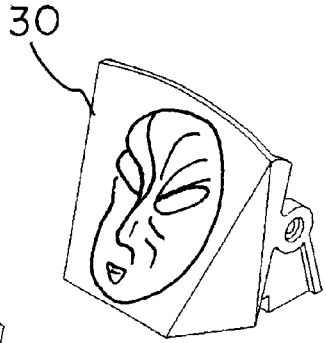
Figure 6C:
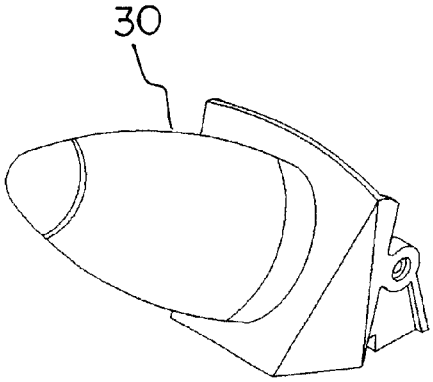
Figure 7:
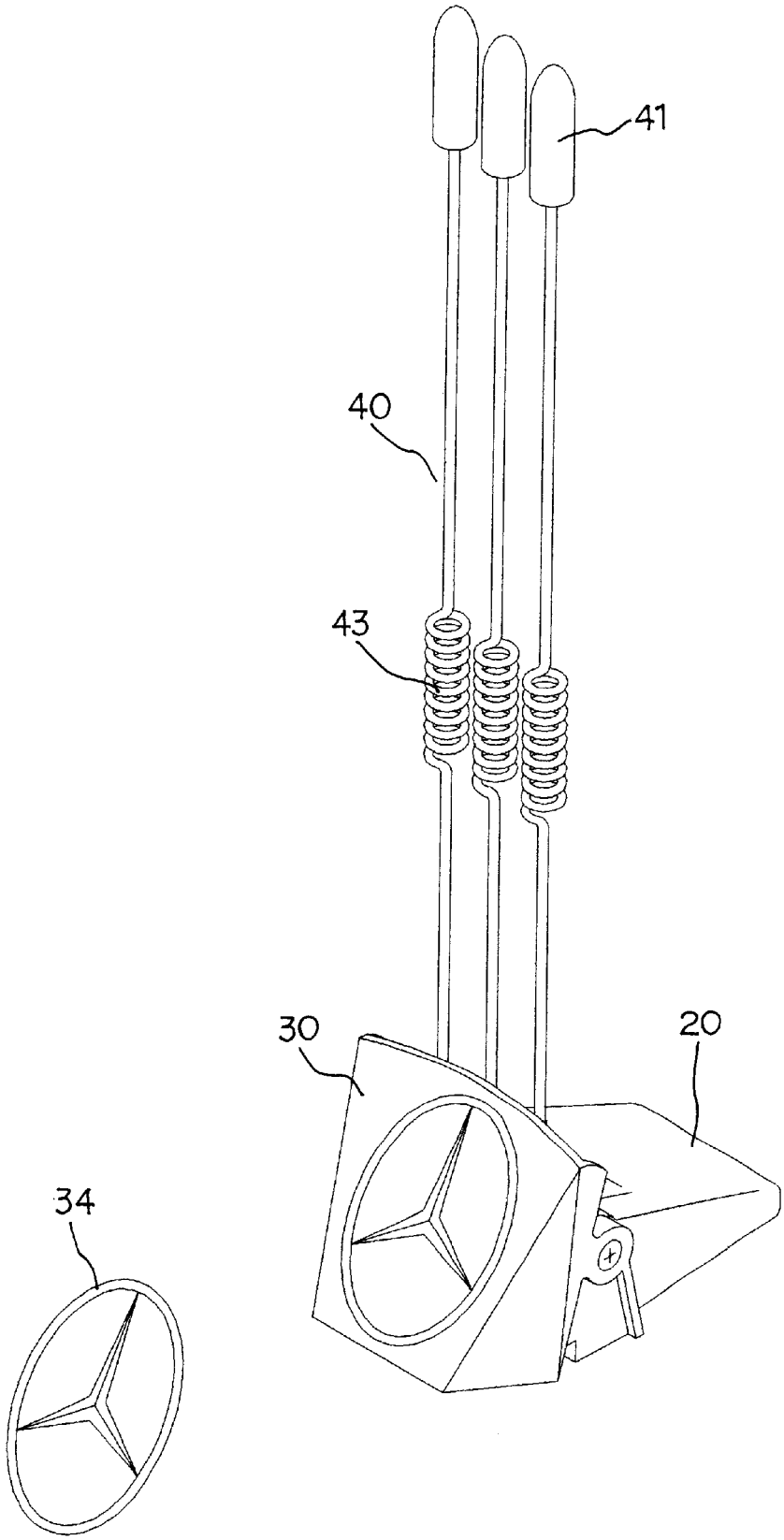
FIG. 7 shows still another embodiment of the present invention.

FIG. 5 shows the installation of the antenna seat of the present invention on a car. By means of the adhesive tape 17 on the bottom face of the base seat 10, the antenna seat can be easily and freely mounted at a desired position of the car body.

Figure 8A:
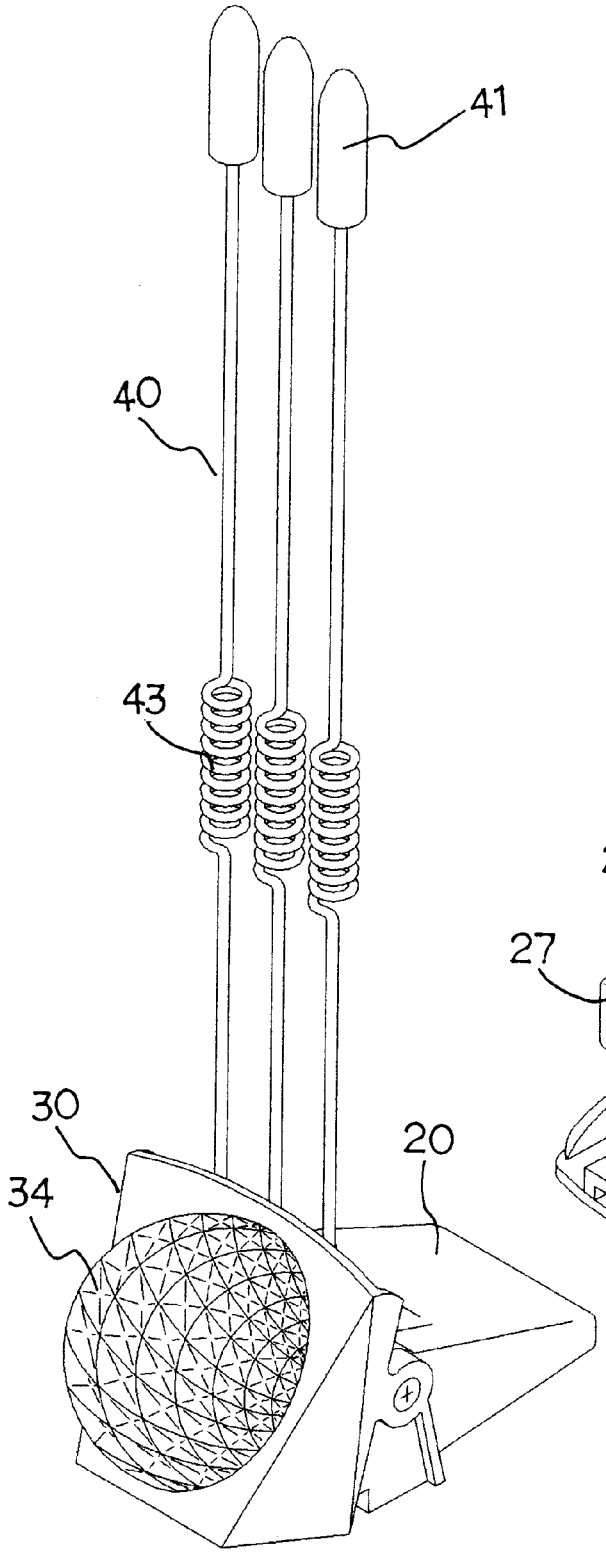
FIGS. 8A to 8B show still another embodiment of the present invention.
Figure 8B:
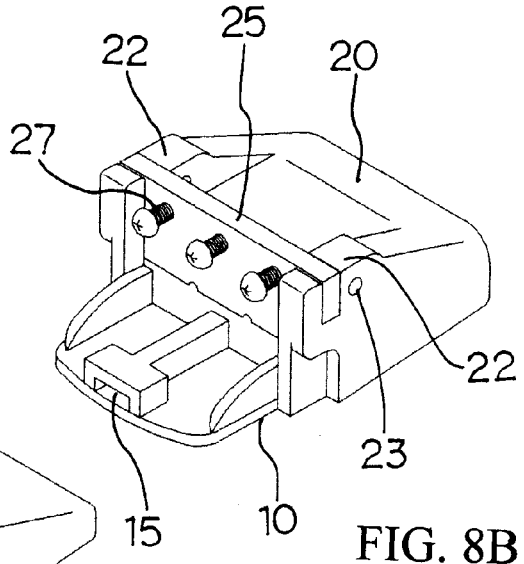

As shown in FIGS. 6A to 6C and FIG. 7, the base seat 10 can be cooperatively assembled with various kinds of solid or plane decorative covers 30 with different characteristics and patterns. FIGS. 8A and 8B show that the base seat can be assembled with different upper covers 20 with different patterns so as to provide versatile appearances and achieve a decorative effect.

The above embodiments are only used to illustrate the present invention, not intended to limit the scope thereof. Many modifications of the above embodiments can be made without departing from the spirit of the present invention.

What is claimed is:

1. A car antenna seat comprising:

a base seat, a half section of a top face of the base seat being formed with an arch slope face which is formed with opposite through holes, the other half of the top face being formed with several receptacles adjacent to the slope face, an engaging socket extending from a rear end of the receptacle, a double-face adhesive tape being disposed on a bottom face of the base seat;

an upper cover mating with and covering the slope face of the base seat, an inner wall face of the upper cover being formed with locating posts for inserting into the through holes of the base seat, two sides of a rear end of the upper cover being formed with two lugs each having a circular hole, a notch being formed beside the lug for a stopper block to insert therein;

a decorative cover mating with and covering the receptacles of the base seat, two sides of a face of the decorative cover mating with the upper cover being formed with opposite connecting holes, an inner bottom face of the decorative cover being disposed with an engaging block for inserting into the engaging socket of the base seat, a surface of the decorative cover being formed with a solid decorative pattern; and at least one antenna which is integrally formed, a light emitting section being disposed at top end of the antenna, the light emitting section containing a diode enclosed by a transparent shade, a middle section of the antenna being formed with a spring pattern, a bottom end of the antenna being disposed with an insertion section.

2. A car antenna seat as claimed in claim 1, wherein the stopper block is formed with several through holes at equal intervals and adjustment screws are passed through the through holes.

3. A car antenna seat as claimed in claim 1, wherein the solid decorative pattern is integrally formed on the surface of the decorative cover.

4. A car antenna seat as claimed in claim 1, wherein the receptacles of the base seat are separated from each other by ribs.

* * * * *